United States Patent [19]

Stricklin et al.

[11] Patent Number: 4,782,536

[45] Date of Patent: Nov. 8, 1988

[54] EMERGENCY SAFETY HELMET

[76] Inventors: Bobby R. Stricklin, 621 E. Tennessee St., Florence, Ala. 35630; George Spector, 233 Broadway, RM 3815, New York, N.Y. 10007

[21] Appl. No.: 40,092

[22] Filed: Apr. 20, 1987

[51] Int. Cl.[4] ..... A42B 3/00

[52] U.S. Cl. ..... 2/414; 2/209.2

[58] Field of Search ..... 2/5, 6, 209.2, 410, 2/414, 425

[56] References Cited

U.S. PATENT DOCUMENTS

| | | | |
|---|---|---|---|
| 2,640,980 | 6/1953 | Prupis | 2/410 X |
| 3,201,771 | 8/1965 | Proulx | 2/5 X |
| 4,648,131 | 3/1987 | Kawaguchi et al. | 2/410 X |
| 4,667,274 | 5/1987 | Daniel | 2/209.2 X |

FOREIGN PATENT DOCUMENTS

| | | | |
|---|---|---|---|
| 47712 | 3/1982 | European Pat. Off. | 2/425 |
| 856430 | 8/1981 | U.S.S.R. | 2/425 |
| 2076276 | 12/1981 | United Kingdom | 2/209.2 |
| 2161696 | 1/1986 | United Kingdom | 2/425 |

*Primary Examiner*—Wm. Carter Reynolds

[57] ABSTRACT

An emergency safety helmet is provided in which the entire electrical circuitry is carried within the safety helmet for powering and controlling a strobe light thereon which projects light beams therefrom while freeing hands of a wearer of the safety helmet for doing other types of work.

3 Claims, 1 Drawing Sheet

EMERGENCY SAFETY HELMET

BACKGROUND OF THE INVENTION

The instant invention relates generally to protective helmets and more specifically it relates to an emergency safety helmet.

Numerous protective helmets have been provided in prior art that are adapted to carry illuminating devices, such as lamp assemblies and the like. For example, U.S. Pat. Nos. 1,749,998; 3,142,833 and 4,521,831 all are illustrative of such prior art. While these units may be suitable for the particular purpose to which they address, they would not be as suitable for the purposes of the present invention as heretofore described.

SUMMARY OF THE INVENTION

A primary object of the present invention is to provide an emergency safety helmet that will overcome the shortcomings of the prior art devices.

Another object is to provide an emergency safety helmet that has a built-in illumination system capable of projecting light beams therefrom while freeing hands of a person wearing the safety helmet for doing other types of work.

An additional object is to provide an emergency safety helmet in which the entire electrical circuitry is carried within the safety helmet for powering and controlling a strobe light thereon.

A further object is to provide an emergency safety helmet that is simple and easy to use.

A still further object is to provide an emergency safety helmet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
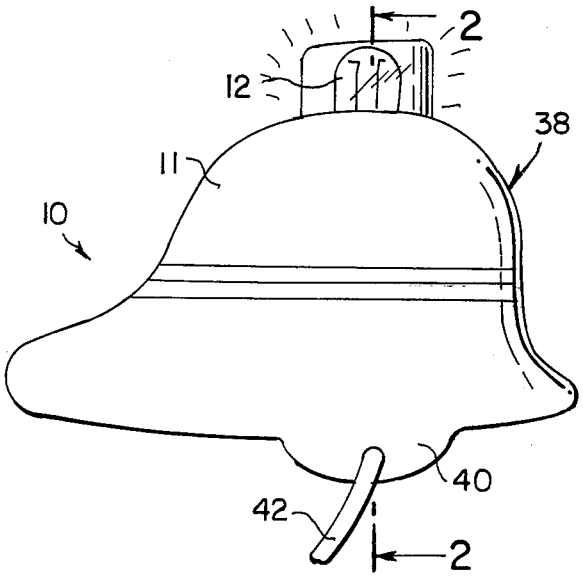
FIG. 1 is a side view of the safety helmet invention.
Figure 2:
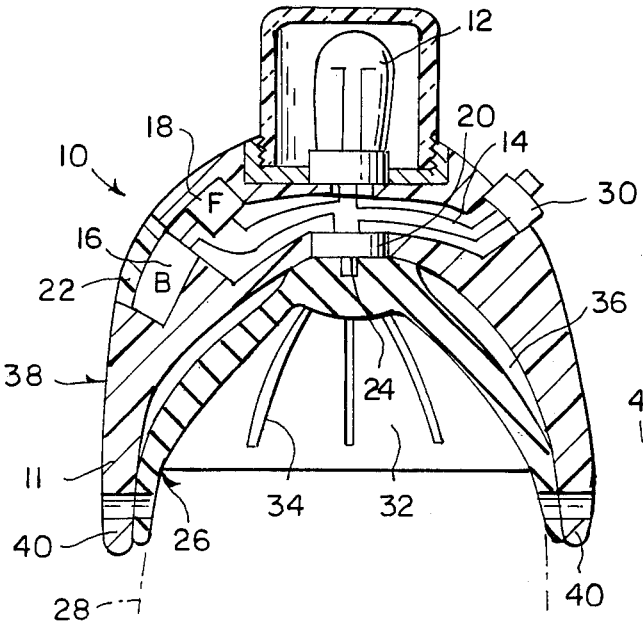
FIG. 2 is a cross sectional view taken along line 2—2 in FIG. 1 showing internal electrical circuitry within for operating the strobe light.
Figure 3:
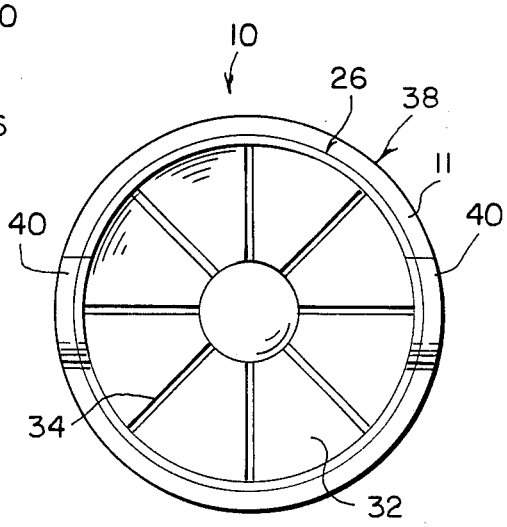
FIG. 3 is a bottom view of the helmet showing segmented side portions of the soft inner liner.

Turning now descriptively to the drawings, in which similar reference characters denote similar elements throughout the several views, FIGS. 1 to 3 illustrate an emergency safety helmet 10 made of stiff material 11 and containing a strobe lamp 12 connected to top of the safety helmet. An electrical circuit 14 is disposed within the safety helmet 10. A power supply 16 being a dry cell battery is connected to the electrical circuit 14 within the safety helmet in which the power supply has a source of electricity for energizing the strobe lamp 12. A flasher 18 is connected to the electrical circuit 14 within the safety helmet 10 between the strobe lamp 12 and the power supply 16 for interrupting the electrical connection between the strobe lamp 12 and the power supply 16 at predetermined intervals. A normally opened switch 20 is connected to the electrical circuit 14 within the safety helmet 10 that can be manually operated for closing the electrical circuit.

An access door 22 is disposed in the safety helmet 10 so as to replace the dry cell battery 16 when needed. The switch 20 is a push button type having an operating member 24 extending downwardly into the interior of the safety helmet. A soft inner liner 26 is secured within the safety helmet and is adapted to engage the operating member 24 of the switch 20 when head 28 of a wearer, shown in phantom, presses the soft inner liner to move the operating member 24 of the switch.

A second switch 30 being a slide type is positioned on top of the safety helmet 10. The second switch is connected to the electrical circuit 14 within the safety helmet. The second switch 30 can be manually operated for opening and closing the electrical circuit 14 independently from the first switch 20 so that in one instance the safety helmet 10 can be worn on the head 28 of the wearer with the strobe lamp 12 in an off position.

The soft inner liner 26 further includes a plurality of segmented side portions 32 having a plurality of slots 34 therebetween to provide for air circulation in space 36 between the soft inner liner 26 and the safety helmet 10 when worn on the head 28 of the wearer.

The safety helmet 10 can come in all different styles, one of which is illustrated as a half hard hat 38 having open ears 40 with an optional chin strap 42 therein. The strobe lamp 12 can come in different colors such as red, blue, green, etc. to be used for different situations and the safety helmet 10 itself can also come in different colors to be used by the police/state troopers, school crossing guards, utility workmen and for street/highway flagmen.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An emergency safety helmet comprising:

(a) a strobe lamp connected to top of said safety helmet;

(b) an electrical circuit disposed within said safety helmet;

(c) a power supply connected to said electrical circuit within said safety helmet, said power supply having a source of electricity for energizing said strobe lamp;

(d) a flasher connected to said electrical circuit within said safety helmet between said strobe lamp and said power supply for interrupting electrical connection between said strobe lamp and said power supply at predetermined intervals;

(e) a normally opened switch connected to said electrical circuit within said safety helmet that can be manually operated for closing said electrical circuit;

(f) said power supply being a dry cell battery;

(g) an access door disposed in said safety helmet so as to replace said dry cell battery when needed;

(h) said switch being a push button type having an operating member extending downwardly into interior of said safety helmet; and (i) a soft inner liner secured within said safety helmet adapted to engage said operating member of said switch when head of a wearer presses said soft inner liner to move said operating member of said switch.

2. An emergency safety helmet as recited in claim 1, further comprising a second switch being a slide type positioned on top of said safety helmet, said second switch connected to said electrical circuit within said safety helmet, said second switch can be manually operated for opening and closing said electrical circuit independantly from said first seitch so that in one instance said safety helmet can be worn on the head of the wearer with said strobe lamp in an off position.

3. An emergency safety helmet as recited in claim 2, wherein said soft inner liner further includes a plurality of segmented side portions having a plurality of slots therebetween to provide for air circulation in space between said soft liner and said safety helmet when worn on the head of the wearer

* * * * *